US009718284B2

(12) United States Patent
Hirose

(10) Patent No.: US 9,718,284 B2
(45) Date of Patent: Aug. 1, 2017

(54) SHEET EJECTING DEVICE

(71) Applicant: Brother Kogyo Kabushiki Kaisha, Nagoya-shi, Aichi-ken (JP)

(72) Inventor: Atsuo Hirose, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/086,242

(22) Filed: Mar. 31, 2016

(65) Prior Publication Data

US 2016/0288537 A1 Oct. 6, 2016

(30) Foreign Application Priority Data

Mar. 31, 2015 (JP) ..... 2015-071125

(51) Int. Cl.

| | |
|---|---|
| ***B65H 31/24*** | (2006.01) |
| ***B65H 31/02*** | (2006.01) |
| ***B65H 39/11*** | (2006.01) |
| ***B41J 11/00*** | (2006.01) |
| ***B41J 11/58*** | (2006.01) |
| ***B65H 29/52*** | (2006.01) |
| ***B65H 43/06*** | (2006.01) |

(52) U.S. Cl.

CPC ..... *B41J 11/0045* (2013.01); *B41J 11/58* (2013.01); *B65H 29/52* (2013.01); *B65H 31/02* (2013.01); *B65H 31/24* (2013.01); *B65H 39/11* (2013.01); *B65H 43/06* (2013.01); *B65H 2301/4212* (2013.01); *B65H 2404/63* (2013.01); *B65H 2405/115* (2013.01); *B65H 2405/1111* (2013.01); *B65H 2405/11151* (2013.01); *B65H 2405/3311* (2013.01); *B65H 2408/111* (2013.01); *B65H 2801/06* (2013.01)

(58) Field of Classification Search

CPC ..... B65H 31/26; B65H 31/24; B65H 31/02; B65H 29/52; B65H 29/70; B65H 39/11

See application file for complete search history.

(56) References Cited

U.S. PATENT DOCUMENTS

| | | | | |
|---|---|---|---|---|
| 6,295,081 | B1 | 9/2001 | Kashima et al. | |
| 6,308,952 | B1 | 10/2001 | Takagi et al. | |
| 6,331,003 | B1 | 12/2001 | Yokota et al. | |
| 6,443,449 | B1 | 9/2002 | Takagi et al. | |
| 7,149,011 | B2 * | 12/2006 | Kawamura | B41J 13/02 358/468 |

(Continued)

FOREIGN PATENT DOCUMENTS

| | | | |
|---|---|---|---|
| JP | S59-177252 | A | 10/1984 |
| JP | H04-107747 | U | 9/1992 |

(Continued)

*Primary Examiner* — Luis A Gonzalez

(74) *Attorney, Agent, or Firm* — Banner & Witcoff, Ltd.

(57) ABSTRACT

A sheet ejecting device having a first ejection tray, a first ejection roller to eject the sheet to the first ejection tray, a second ejection tray in a position above the first ejection tray, a second ejection roller to eject the sheet to the second ejection tray, and a first guide and a second guide disposed in widthwise end portions on a lower surface of the second ejection tray, is provided. The first guide and the second guide are configured to contact widthwise end portions of the sheet ejected by the first ejection roller and guide the widthwise end portions of the sheet downward.

10 Claims, 9 Drawing Sheets

(56) References Cited

U.S. PATENT DOCUMENTS

| | | | | |
|---|---|---|---|---|
| 8,757,791 | B2 * | 6/2014 | Tanaka | B41J 13/106 271/290 |
| 2005/0201793 | A1 * | 9/2005 | Satozaki | G03G 15/6552 399/405 |
| 2007/0177916 | A1 * | 8/2007 | Ninomiya | G03G 15/235 399/405 |

FOREIGN PATENT DOCUMENTS

| | | | | |
|---|---|---|---|---|
| JP | H04-277165 | A | | 10/1992 |
| JP | H07-277579 | A | | 10/1995 |
| JP | H11-228013 | A | | 8/1999 |
| JP | 2002211814 | A | * | 7/2002 |
| JP | 2004137070 | A | * | 5/2004 |
| JP | 2005053648 | A | * | 3/2005 |
| JP | 2005350182 | A | * | 12/2005 |
| JP | 2006151667 | A | * | 6/2006 |
| JP | 2008120494 | A | * | 5/2008 |

* cited by examiner

SHEET EJECTING DEVICE

CROSS REFERENCE TO RELATED APPLICATION

This application claims priority from Japanese Patent Application No. 2015-071125, filed on Mar. 31, 2015, the entire subject matters of which are incorporated herein by reference.

BACKGROUND

Technical Field

An aspect of the present disclosure relates to a sheet ejecting device configured to eject a sheet.

Related Art

A sheet ejecting device having a plurality of ejection trays aligning vertically is known. Such a sheet ejecting device may be mounted on, for example, an image forming apparatus to form an image on the sheet. The plurality of ejection trays may be detachably attached to a supporting member, such as a casing, of the sheet ejecting device.

SUMMARY

When the sheet with an image formed thereon is ejected by the sheet ejecting device and settled on an ejection tray, the sheet may be curled into a roll elongated in a sheet-ejecting direction, or into a shape of a half-pipe, in which widthwise ends of the sheet are rounded upward.

When the curled sheet is ejected and placed on one of the ejection trays, and another sheet is successively ejected on the same ejection tray, the successive sheet may collide with the preceding sheet, and the preceding sheet may be pushed out of the ejection tray. Thus, stacking capacity of the ejection tray may be lowered.

The present disclosure is advantageous in that a sheet ejecting device, in which the sheet-stacking capacity may not be lowered even when a preceding sheet is curled into a roll, is provided.

According to an aspect of the present disclosure, a sheet ejecting device, including a first ejection tray, a first ejection roller configured to eject a sheet to the first ejection tray in a sheet-ejecting direction, a second ejection tray disposed above the first ejection tray, a second ejection roller configured to eject a sheet to the second ejection tray, and a first guide and a second guide, is provided. The first guide and the second guide are disposed in a downstream portion on a lower surface of the second ejection tray in the sheet-ejecting direction. The lower surface of the second ejection tray faces the first ejection tray. The first guide is disposed in a first widthwise end portion of the downstream portion on the lower surface of the second ejection tray in a widthwise direction being orthogonal to the sheet-ejecting direction, and the second guide is disposed in a second widthwise end portion opposite to the first widthwise end portion in the widthwise direction. The first guide and the second guide are configured to contact a first widthwise end portion and a second widthwise end portion, respectively, in the widthwise direction, of the sheet ejected by the first ejection roller and guide downward the first widthwise end portion and the second widthwise end portion, respectively, of the sheet.

BRIEF DESCRIPTION OF THE ACCOMPANYING DRAWINGS

DETAILED DESCRIPTION

Hereinafter, a sheet ejecting device 10 according to an embodiment of the present disclosure mounted on an image forming apparatus 1 will be described with reference to the accompanying drawings. It is noted that various connections may be set forth between elements in the following description. These connections in general, and unless specified otherwise, may be direct or indirect, and this specification is not intended to be limiting in this respect.

In the following description, parts and items that are identical to one another may be referred to by a same reference sign, and redundant explanation of those may be omitted. A quantity of each element, part, or item is, unless specified otherwise, at least one. The present embodiment may not necessarily be limited to the embodiment described below. In the following description, the image forming apparatus 1 may refer to an image forming apparatus with the sheet ejecting device 10 mounted thereon.

1. Overall Configuration of the Image Forming Apparatus

The sheet ejecting device 10 according to the present embodiment is mounted on the image forming apparatus 1, in an upper position with respect to a sheet outlet 2. The image forming apparatus 1 includes a housing 3, which accommodates an image forming unit (not shown) to form an image on a sheet.

On a top plane of the housing 3, arranged is an ejection tray 3A, on which the sheet with an image formed thereon may be settled. In the present embodiment, the sheet may be settled on the ejection tray 3A when the sheet ejecting device 10 is not used. When the sheet ejecting device is used, the sheet being conveyed out of the image forming apparatus 1 may be ejected to at least one of a plurality of ejection trays 11-14.

Figure 1:
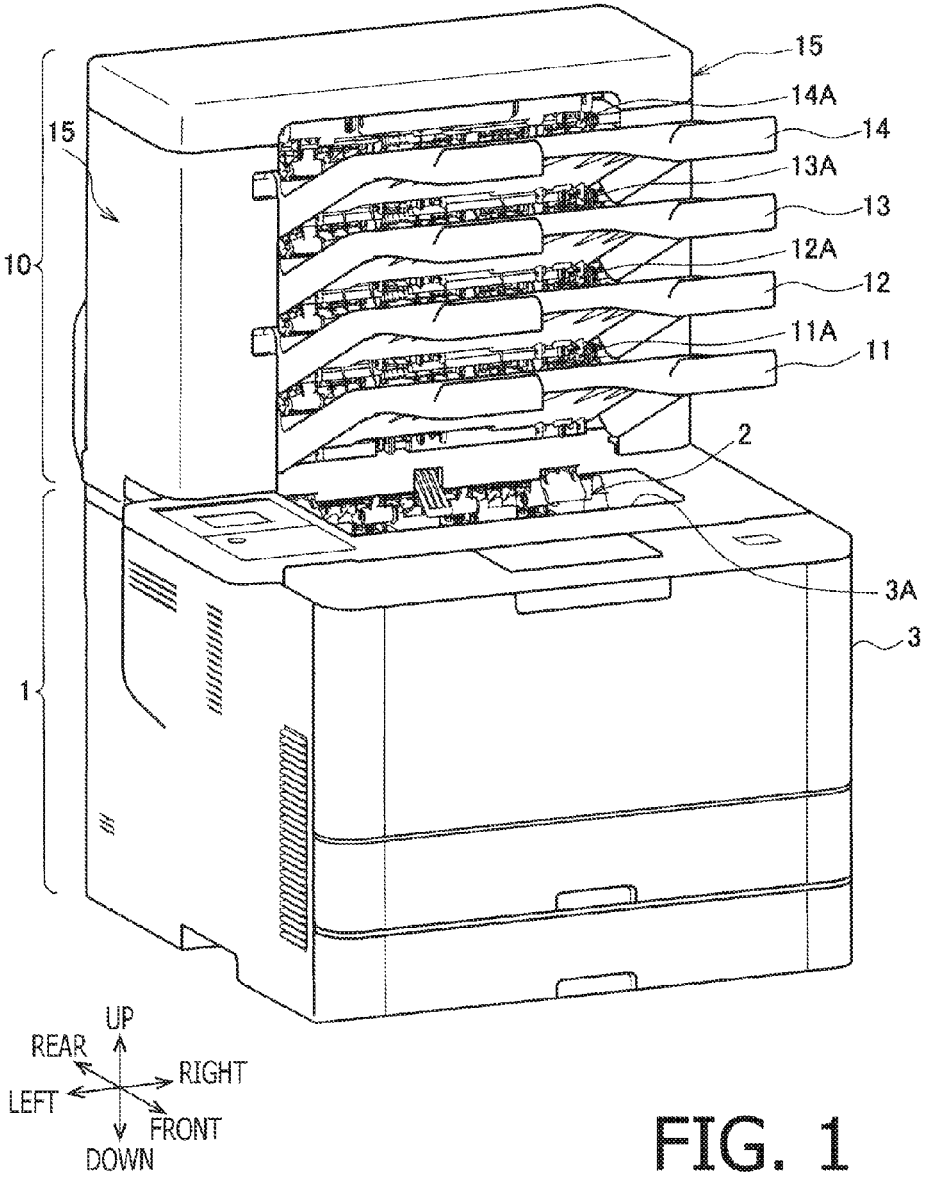
FIG. 1 is a perspective view of an image forming apparatus with a sheet ejecting device mounted thereon according to an embodiment of the present disclosure.

2. Sheet Ejecting Device 2-1. Overall Configuration of the Sheet Ejecting Device The sheet ejecting device 10 includes, as shown in FIG. 1, the plurality of ejection trays 11-14. The sheet ejecting device 10 may convey and direct the sheet to a designated one of the ejection trays 11-14 according to a sheet-ejecting setting designated by a user.

One or more sheets ejected out of the image forming apparatus 1 may be stacked on the ejection trays 11-14. The ejection trays 11-14 are attached to a supporting section 15 to align vertically. The ejected sheets may be settled on upper surfaces of the ejection trays 11-14.

In the following description, among the ejection trays 11-14, an ejection tray which is at a lowermost position will be referred to as a first ejection tray 11, and an ejection tray which is at an upper position with respect to the first ejection tray 11 and lower position with respect to the other ejection trays 13, 14 will be referred to as a second ejection tray 12. Further, an ejection tray which is at an upper position with respect to the second ejection tray 12 and a lower position with respect to the other ejection tray 14 will be referred to as a third ejection tray 13, and an ejection tray which is at an upper position with respect to the third ejection tray 13 will be referred to as a fourth ejection tray 14.

Among the first through fourth ejection trays 11-14, at least the second ejection tray 12 and the fourth ejection tray 14 may be detachable from the supporting section 15. In other words, the user may attach and detach the second and fourth ejection trays 12, 14 to and from the supporting section 15. The first ejection tray 11 and the third ejection tray 13 may or may not be detachable from the supporting section 15. A condition, in which the second and fourth ejection trays 12, 14 are detached from the supporting section 15, may be referred to as a stacker-mode condition.

Figure 2:
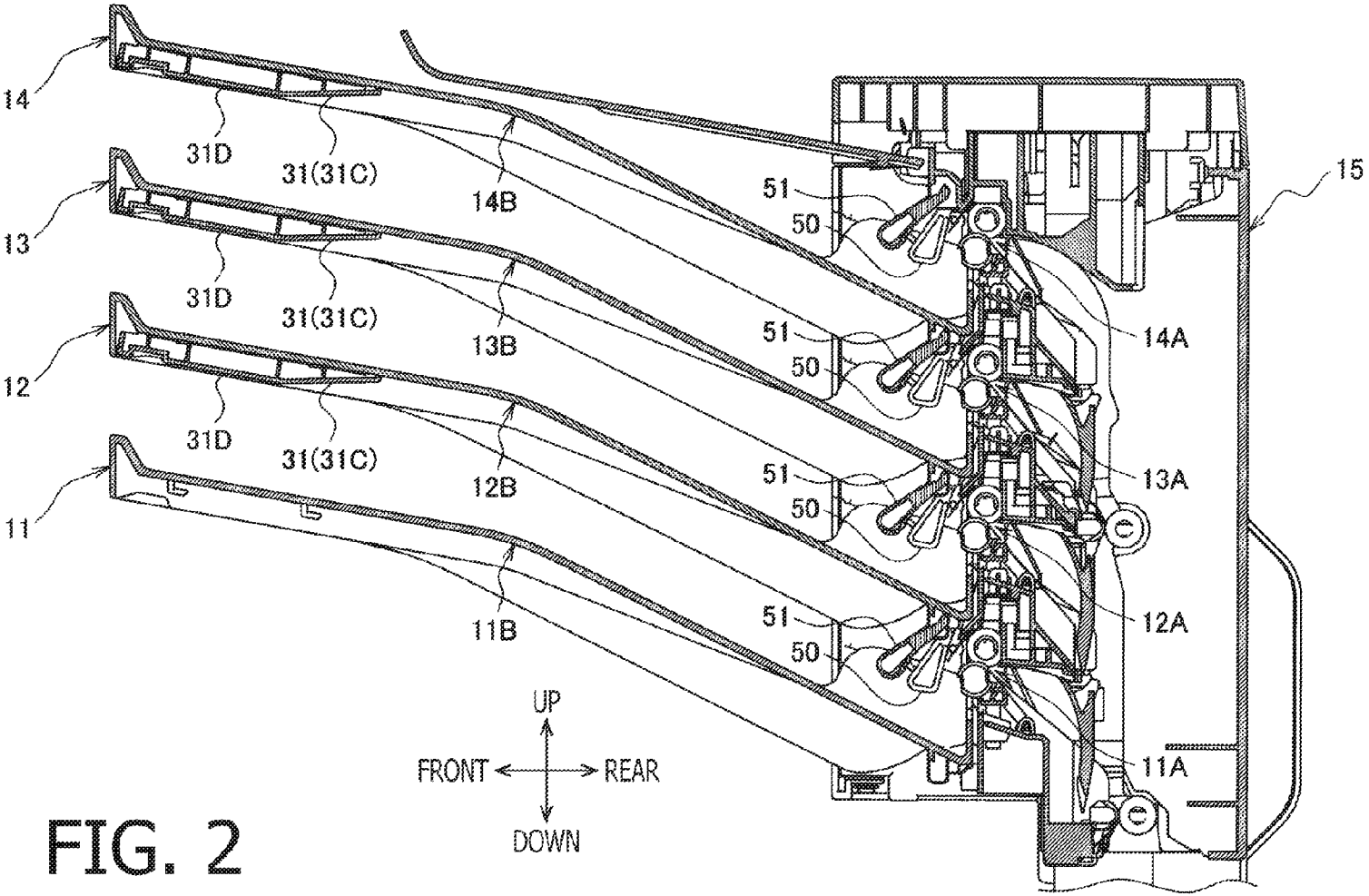
FIG. 2 is a cross-sectional view of the sheet ejecting device according to the embodiment of the present disclosure.

The supporting section 15 includes, as shown in FIG. 2, a plurality of sheet exits, including first, second third, and fourth sheet exits 11A, 12A, 13A, 14A, through which the sheets with images formed thereon are ejected out of the image forming apparatus 1 and directed to the first, second, third, and fourth ejection trays 11, 12, 13, 14. The first, second third, fourth sheet exits 11A, 12A, 13A, 14A are arranged vertically to correspond to the first, second, third, fourth ejection trays 11, 12, 13, 14 respectively.

The first sheet exit 11A is formed to open toward an upper surface 40 of the first ejection tray 11. The second, third, fourth exits 12A, 13A, 14A are formed to open toward upper surfaces 40 of the second, third, fourth ejection trays 12, 13, 14, respectively.

Figure 3:
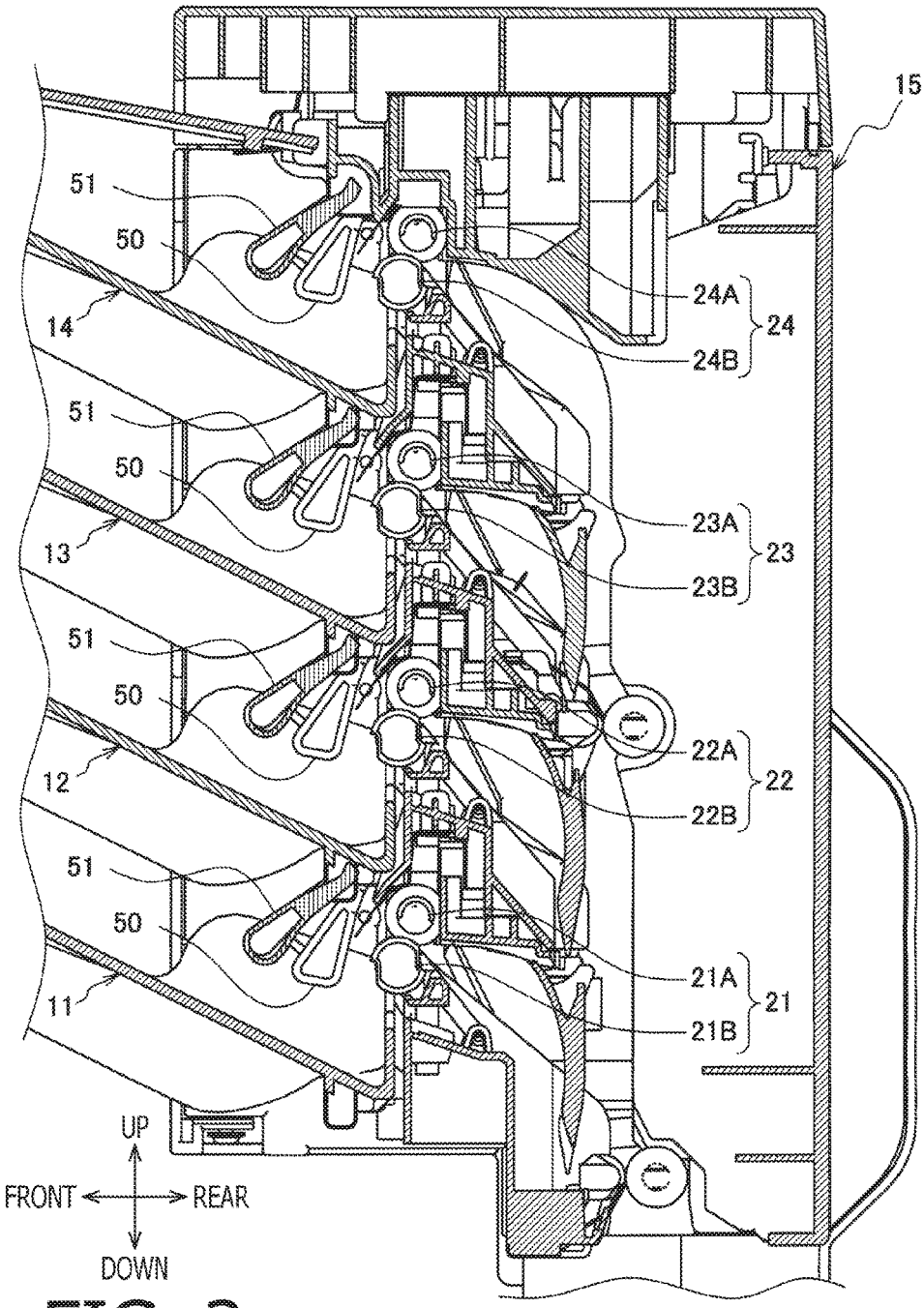
FIG. 3 is a partly enlarged cross-sectional view of the sheet ejecting device according to the embodiment of the present disclosure.

At the first sheet exit 11A, as shown in FIG. 3, arranged is a first ejection roller 21 including an upper roller 21A and a lower roller 21B. At the second sheet exit 12A, arranged is a second ejection roller 22 including an upper roller 22A and a lower roller 22B. At the third sheet exit 13A, arranged is a third ejection roller 23 including an upper roller 23A and a lower roller 23B. At the fourth sheet exit 14A, arranged is a fourth ejection roller 24A including an upper roller 24A and a lower roller 24B.

2-2. Configuration of the Ejection Trays

Among the plurality of ejection trays 11-14, at least the second, third, and fourth ejection trays 12, 13, 14 are in an identical configuration. Meanwhile, the first ejection tray 11 may be different from the second, third, fourth ejection trays 12-14 in that the first ejection tray 11 may not necessarily have a guide 31 and a parallel portion 31D, while the second, third, fourth ejection trays 12-14 each has the guide 31 and the parallel portion 31D.

The second ejection tray 12 representing the second through fourth ejection trays 12-14 in the upper positions, in relation to the first ejection tray 11 in the lower position, will be described below.

Figure 4:
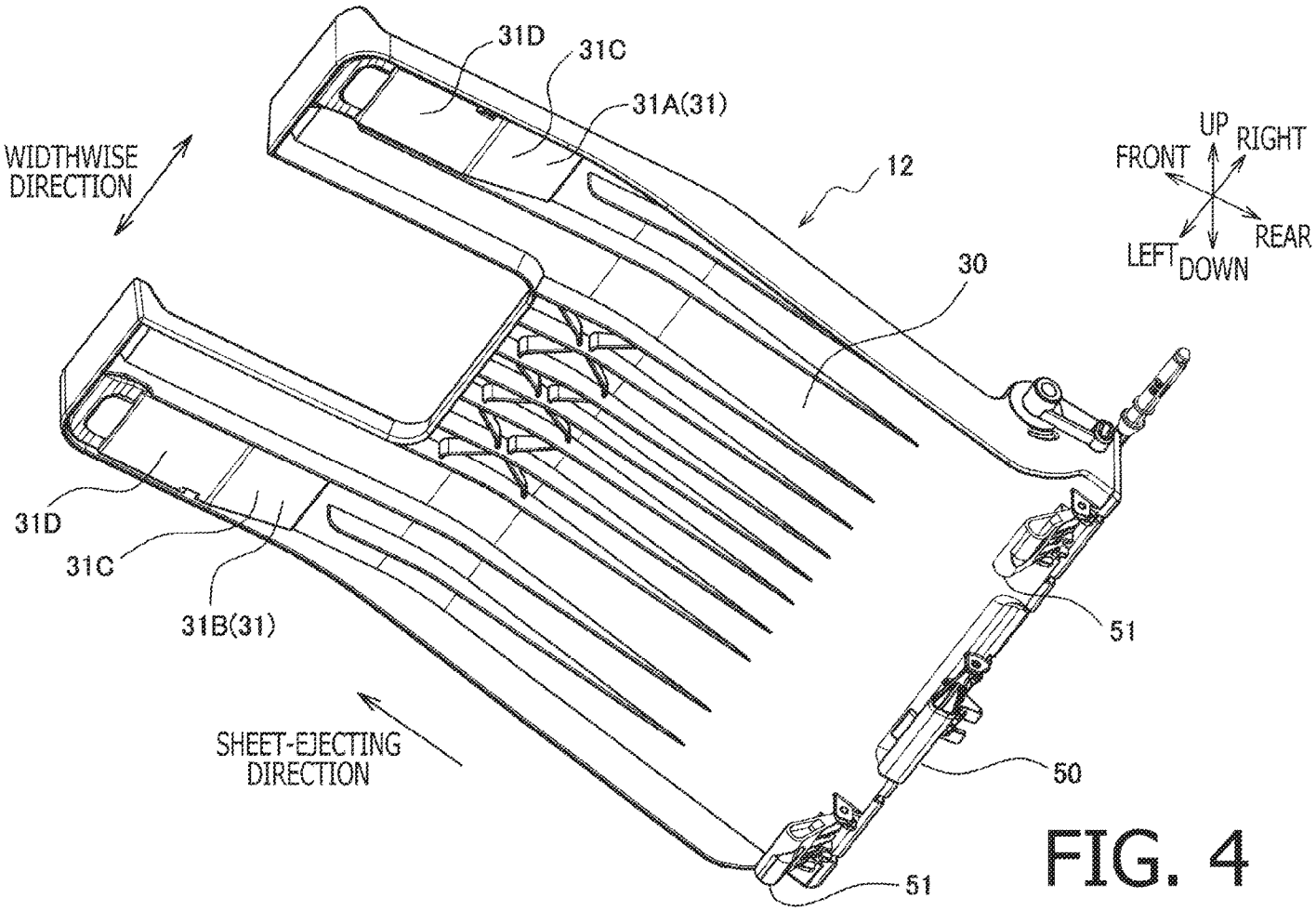
FIG. 4 is a perspective upward view showing a lower surface of a second ejection tray in the sheet ejecting device according to the embodiment of the present disclosure.

As shown in FIG. 4, the second ejection tray 12 includes the guide 31 arranged on a lower surface 30 of the second ejection tray 12, which faces the first ejection tray 11 in the lower position. The guide 31 includes a pair of guides 31, which are a first guide 31A and a second guide 31B.

The first guide 31A is located at a position downstream from a midst area, in a sheet-ejecting direction, and in an area on one of widthwise ends, e.g., on a rightward end, in a widthwise direction, on the lower surface 30 of the second ejection tray 12. The second guide 31B is located at a position downstream from the midst area, in the sheet-ejecting direction, and in an area on the other of widthwise ends, e.g., on a leftward end, in the widthwise direction, on the lower surface 30.

In this regard, the sheet-ejecting direction may refer to a direction to eject the sheet outward through the first, second third, fourth sheet exits 11A, 12A, 13A, 14A to the first, second, third, fourth ejection trays 11, 12, 13, 14. The widthwise direction may refer to a horizontal direction which intersects orthogonally with the sheet-ejecting direction. The midst area may refer to an area in a middle when the first, second, third, fourth ejection trays 11, 12, 13, 14 are trisected along the sheet-ejecting direction.

When a rightward end of the sheet being ejected by the first ejecting roller 21 contacts the first guide 31A, the first guide 31A may guide the contacting rightward end portion of the sheet downward with respect to an extended sheet-ejecting direction, which is a direction hypothetically extended from a path of the sheet having been ejected heretofore on the first ejection tray 11. When a leftward end of the sheet being ejected by the first ejecting roller 21 contacts the second guide 31B, the second guide 31B may guide the contacting leftward end portion of the sheet downward with respect to the extended sheet-ejecting direction.

Figure 5:
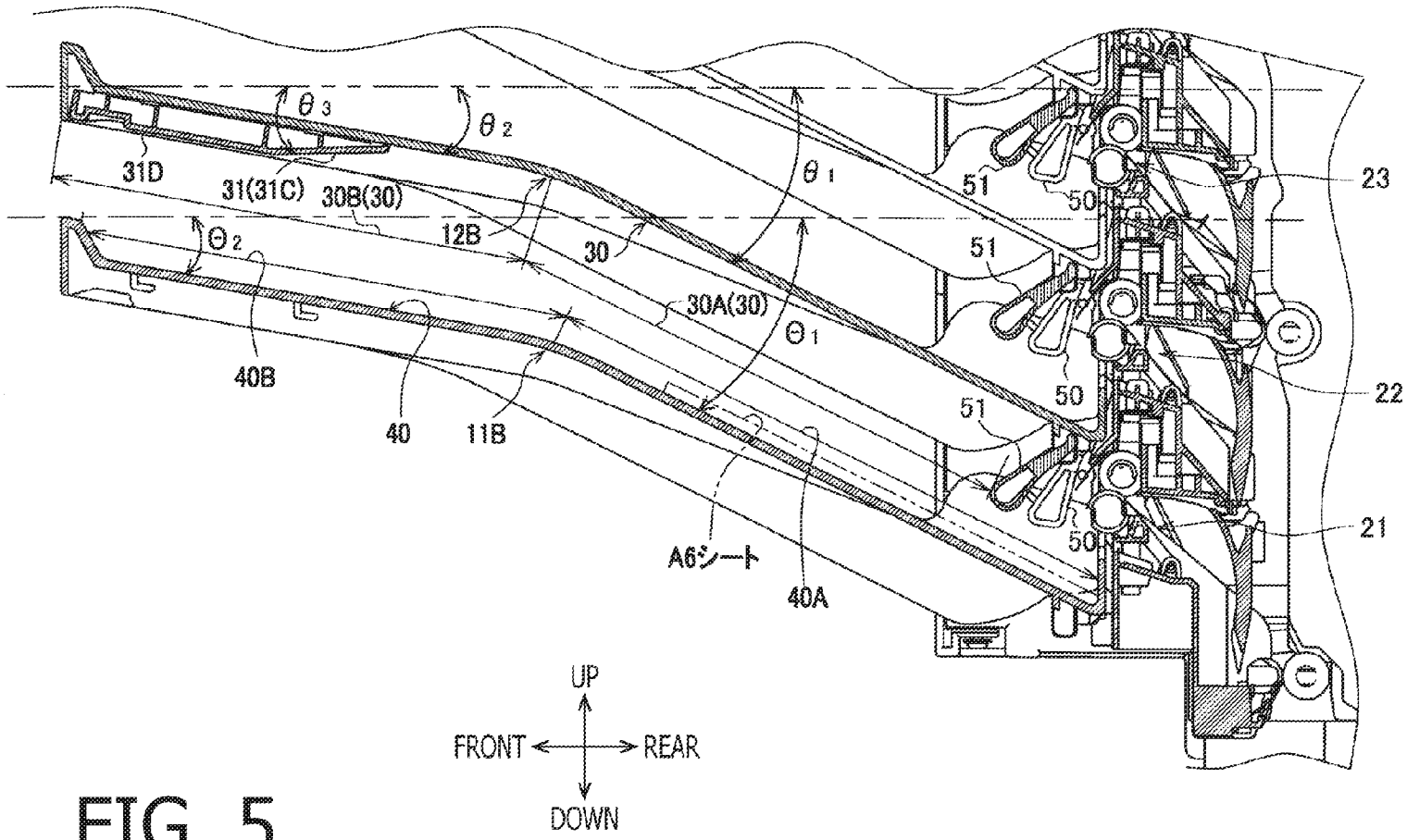
FIG. 5 is a cross-sectional partial view of the sheet ejecting device according to the embodiment of the present disclosure.

The lower surface 30 of the second ejection tray 12 is, as shown in FIG. 5, formed to have a first slanted surface 30A and a second slanted surface 30B. The first slanted surface 30A and the second slanted surface 30B are arranged to adjoin each other along the sheet-ejecting direction.

The first slanted surface 30A is formed in a position to be closer to the first ejection roller 21 than the second slanted surface 30B. The second slanted surface 30B is formed in a position downstream from the first slanted surface 30A, in the sheet-ejecting direction. An angle $\Theta 2$ of the second slanted surface 30B with respect to a horizontal plane is smaller than an angle $\Theta 1$ of the first slanted surface 30A with respect to the horizontal plane. The angle $\Theta 1$ may be, for example, 26 degrees, and the angle $\Theta 2$ may be, for example, 10 degrees.

Meanwhile, an upper surface 40 of the first tray 11 includes a first placement surface 40A and a second placement surface 40B. The first placement surface 40A and the second placement surface 40B are arranged to adjoin each other along the sheet-ejecting direction. The second, third, fourth trays 12, 13, 14 each has an upper surface 40 including a first placement surface 40A and a second placement surface 40B, which are identical to the first placement surface 40A and the second placement surface 40B in the first tray 11.

The first placement surface 40A is formed in a position to be closer to the first ejection roller 21 than the second placement surface 40B. The second placement surface 40B is formed in a position downstream from the first placement surface 40A, in the sheet-ejecting direction. An angle Θ2, e.g., 10 degrees, of the second placement surface 40B with respect to the horizontal plane is smaller than an angle Θ1, e.g., 26 degrees, of the first placement surface 40A with respect to the horizontal plane.

In an upper position with respect to the second placement surface 40B, at least a part of the second slanted surface 30B is arranged to coincide with the second placement surface 40B. In this regard, a placement surface, which includes the first placement surface 40A and the second placement surface 40B, of the first ejection tray 11, and of the second, third, fourth ejection trays 12, 13, 14, may be in a similar shape to a shape of the lower surface 30 of the first ejection tray 11, and the second, third, fourth ejection trays 12, 13, 14, which includes the first slanted surface 30A and the second slanted surface 30B.

The guide 31 is arranged on the second slanted surface 30B and includes a contacting portion 31C, which may contact the sheet being ejected. The contacting portion 31C is formed to have a plane, which inclines at an angle Θ3 with respect to the horizontal plane. The angle Θ3 may be, for example, greater than or equal to zero (0) degree and smaller than or equal to 45 degrees.

In a position downstream from the guide 31 in the sheet-ejecting direction, arranged is the parallel portion 31D. The parallel portion 31D has a plane extended frontward continuously from the guide 31 to spread in parallel with the second placement surface 40B.

As mentioned above, the first ejection tray 11 and the second, third, fourth ejection trays 12, 13, 14 are in the similar configuration except that the second, third, fourth ejection trays 12, 13, 14 each has the guide 31 and the parallel portion 31D. Therefore, with the angle difference between the first placement surface 40A and the second placement surface 40B on the upper surface 40, the first, second, third, fourth ejection trays 11-14 are formed to bend at the midst area. In particular, in a view along the widthwise direction, each of the first, second, third, fourth ejection trays 11-14 may be in an approximate shape of an "L" or a stretched "L."

In other words, the first, second, third, fourth ejection trays 11, 12, 13, 14 are bent at boundaries 11B, 12B, 13B, 14B, which are between the first placement surface 40A and the second placement surface 40B. The boundaries 11B, 12B, 13B, 14B are, as shown in FIG. 5, each in a position downstream from a reference position, which is distanced apart downstream, or frontward, from an upstream end of the first, second, third, and fourth ejection trays 11, 12, 13, 14 respectively, for a predetermined length, in the sheet ejecting direction. The predetermined length may be, for example, an A6 length, which is a dimension of a longer side of an A6-sized (105*148 mm) sheet. For another example, the predetermined length may be a dimension of a longer side of a postcard size (e.g., 4.25*6 inches).

An actuator 50 (see FIG. 3), which may deform by a contact with the sheet, may be located in a position downstream from the first ejection roller 21, in the sheet-ejecting direction. The actuator 50 is movable to at least detect an amount of sheets placed on the first ejection tray 11 reaching a predetermined amount, or a fully-stacked condition.

For example, when the actuator 50 swings, a signal corresponding to the swing movement may be output to a controller (not shown) of either the sheet ejecting device 10 or the image forming apparatus 1. By the input of this signal, the controller may detect the fully-stacked condition in the first ejection tray 11. The actuator 50 may be arranged in the second, third, forth ejection trays 12-14 as well.

The actuator 50 may further detect presence or absence of the sheet being ejected on the first ejection tray 11. Meanwhile, a sheet presser 51 may press widthwise ends of the sheet being ejected downward. The sheet presser 51 may be, as shown in FIG. 4, arranged on each widthwise end of the first ejection tray 11. The sheet presser 51 may be arranged on the second, third, fourth ejection trays 12-14 as well.

The actuator 50 is in a position, in a view projected on a hypothetical vertical plane which spreads in parallel with the widthwise direction, between the guides 31. In other words, as shown in FIG. 6, the actuator 50 is arranged between a hypothetical line L1, which extends in the sheet-ejecting direction from the first guide 31A, and a hypothetical line L2, which extends in the sheet-ejecting direction from the second guide 31B.

Meanwhile, the first ejection roller 21 includes a plurality of roller parts 21C, 21D, which may nip the sheet and rotate, and support shafts 21E, 21F to support the roller parts 21C, 21D, respectively. If the first ejection roller 21 and the guides 31 are projected on a same hypothetical vertical plane spreading in parallel with the widthwise direction, a projected figure of each guide 31 may coincide at least partly with a projected figure of at least one of the roller parts 21C, 21D projected on the hypothetical vertical plane.

Figure 6:
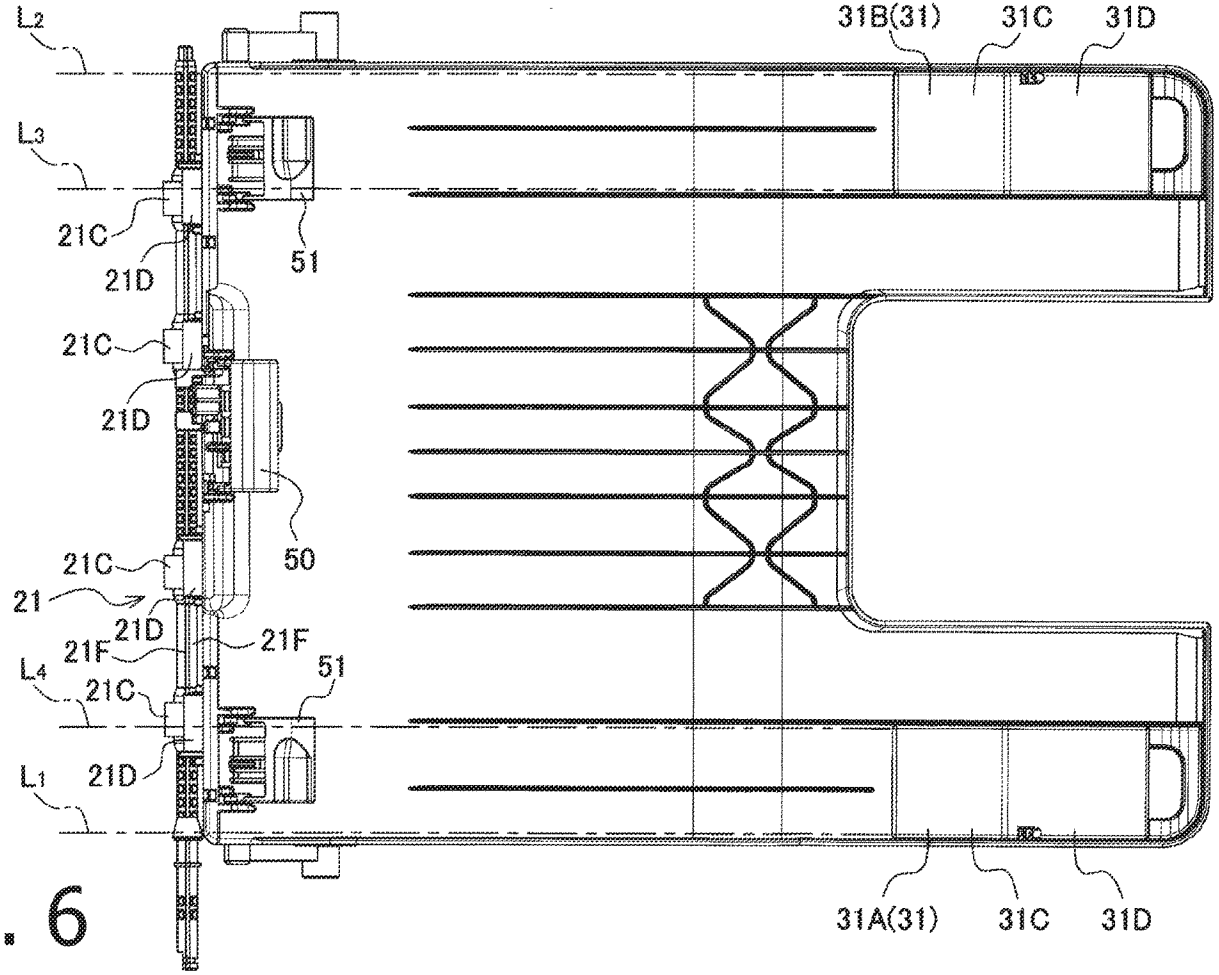
FIG. 6 is a plan view of the lower surface of the second ejection tray 12 in the sheet ejecting device according to the embodiment of the present disclosure.

More specifically, as shown in FIG. 6, at least a part of the roller parts 21, 21D is in a position between the hypothetical line L1 and a hypothetical line L4, which extend from the first guide 31A along the sheet ejecting direction, or in a position between the hypothetical line L2 and a hypothetical line L4, which extend from the second guide 31B along the sheet ejecting direction. In other words, at least a part of the plurality of roller parts 21, 21D are in a same position as at least one of the first guide 31A and the second guide 31B in the widthwise direction.

3. Usability of the Sheet Ejecting Device and the Image Forming Apparatus

According to the sheet-ejecting device 10 or the image forming apparatus 1 described above, the guides 31 are arranged on the lower surface 30, which faces the first ejection tray 11 in the lower position, of the second ejection tray 12 in the upper position. The guide 31, located in the downstream position from the midst area in the sheet-ejecting direction and in the widthwise ends in the widthwise direction, may contact the widthwise end portions of the sheet and guide the widthwise end portions vertically downward to be lower than the extended sheet-ejecting direction by the contact.

Therefore, when the sheet is curled into a roll or a half-pipe, the widthwise ends of the sheet rounded upward may be turned downward to be flattened by the guide 31 as the sheet is being ejected. Thus, the stacking capacity of the first sheet ejection tray 11 in the lower position may be prevented from being lowered.

Figure 7B:
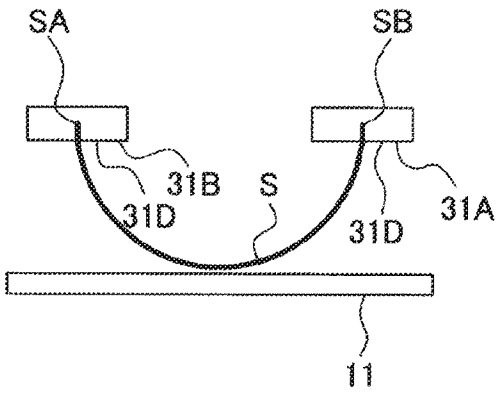
FIGS. 7A and 7B illustrate a behavior of the sheet being ejected on the first ejection tray 11 in the sheet ejecting device according to the embodiment of the present disclosure.
Figure 7A:
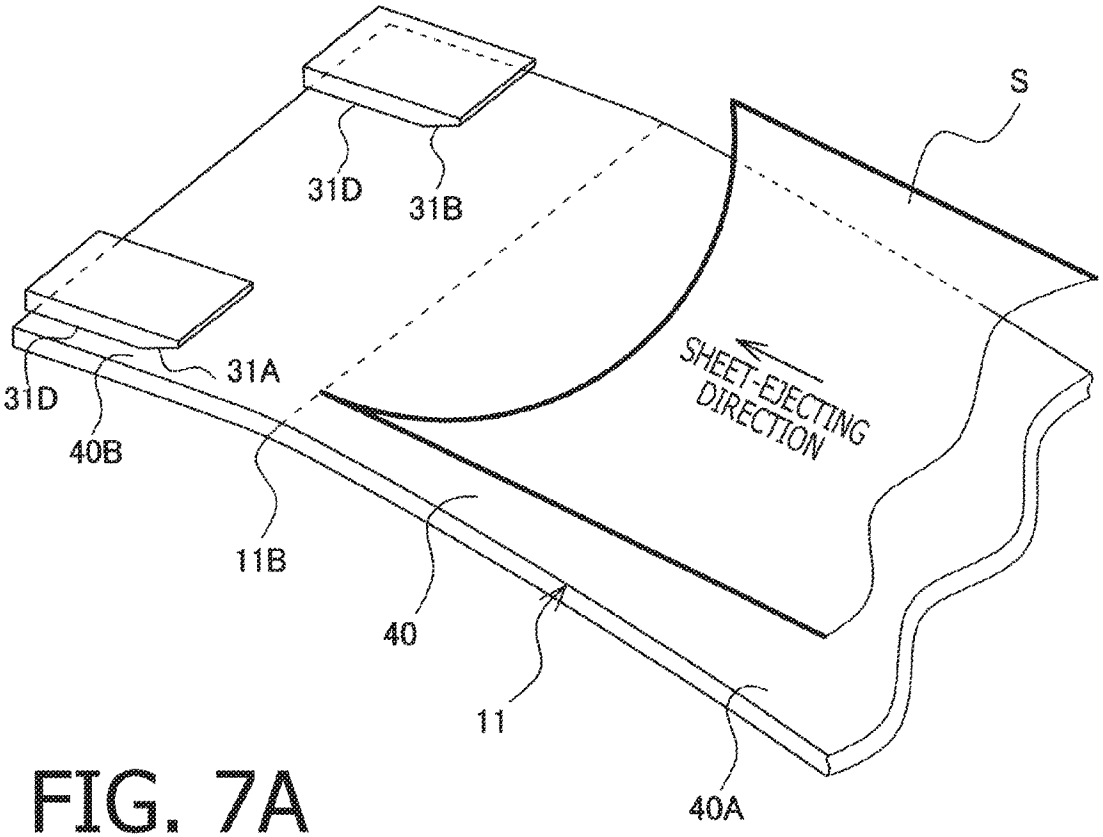
Figure 8B:
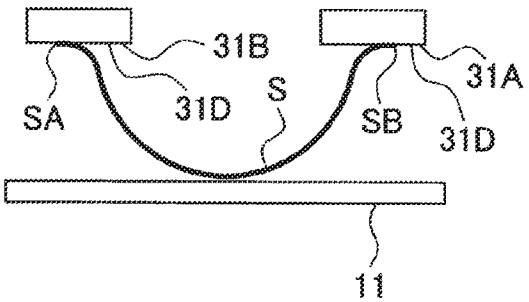
FIGS. 8A and 8B illustrate a behavior of the sheet being ejected on the first ejection tray in the sheet ejecting device according to the embodiment of the present disclosure.
Figure 8A:
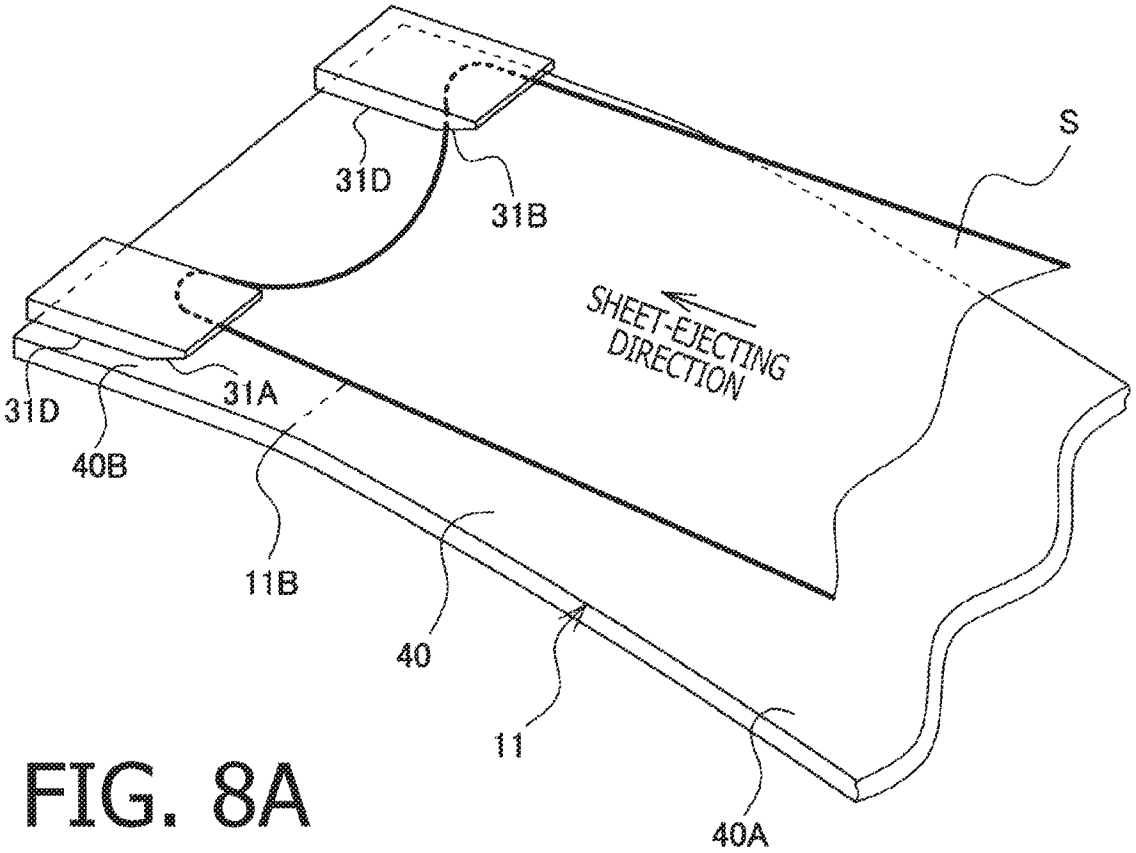

For example, as shown in FIGS. 7A and 7B, a sheet S curled into a half-pipe with the widthwise ends SA, SB rounded upward may be ejected through the first sheet exit 11A. As the sheet S is conveyed frontward, or downstream, along the sheet-ejecting direction, as shown in FIGS. 8A and 8B, the widthwise ends SA, SB of the sheet S may contact the first guide 31A and the second guide 31B respectively.

The first guide 31A and the second guide 31B are located in a frontward position, or a downstream position, from the boundary 12B of the second ejection tray 12 in the sheet-ejecting direction. Therefore, the sheet S being ejected along the first placement surface 40A of the first ejection tray 11 may be pressed downward by the first guide 31A and the second guide 31B, which are arranged on the lower surface 30 of the second ejection tray 12, on the second slanted surface 30B slanted at the angle smaller than the angle of the first slanted surface 30A of the second ejection tray 12.

Figure 9B:
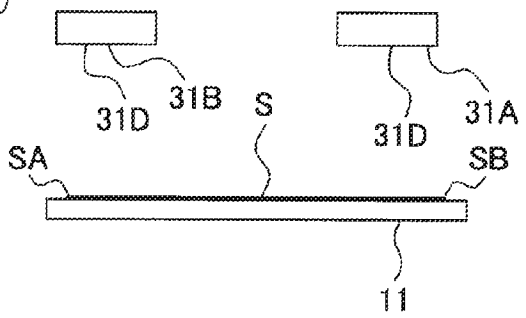
FIGS. 9A and 9B illustrate a behavior of the sheet being ejected on the first ejection tray in the sheet ejecting device according to the embodiment of the present disclosure.
Figure 9A:
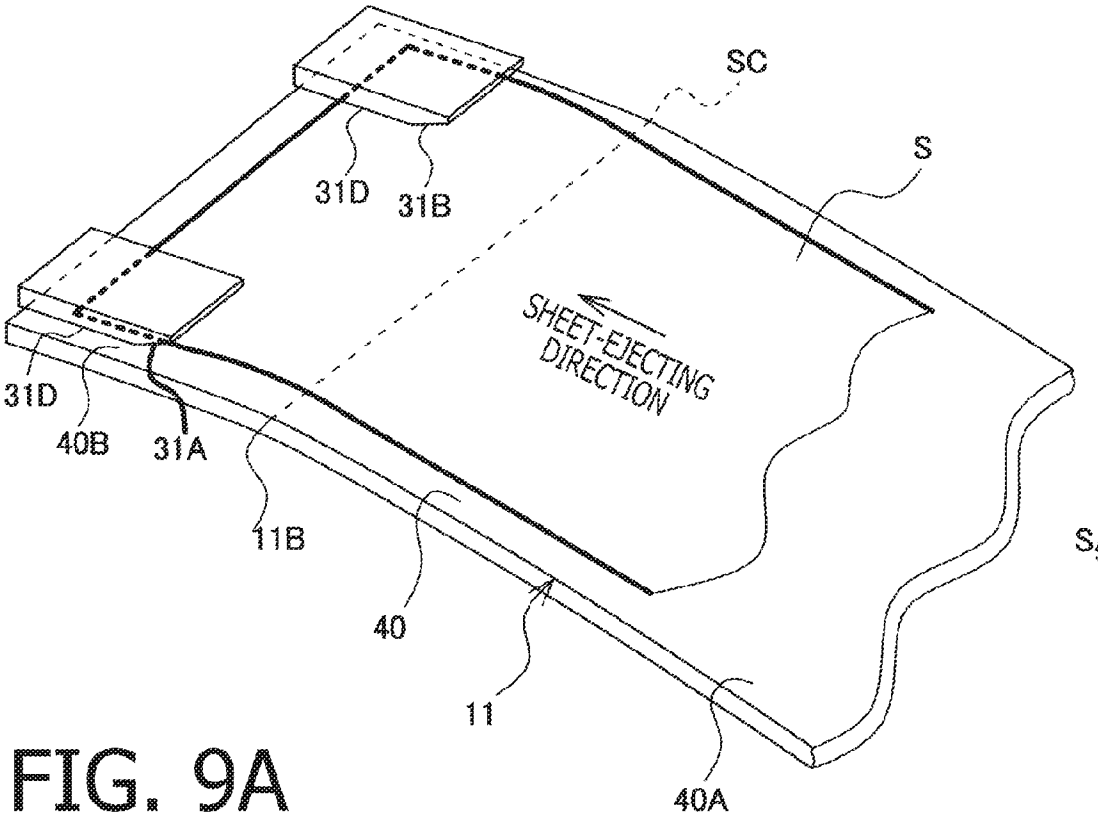

When the widthwise ends SA, SB of the sheet S are pressed downward by the guides 31 (see FIG. 8B), the curl in the sheet S may be moderated. As the sheet S is conveyed further frontward, or downstream, along the sheet-ejecting direction, as shown in FIGS. 9A and 9B, the curl may be removed, and the sheet S may be flattened in the widthwise direction.

The first ejection tray 11 is formed to bend at the boundary 11B between the first placement surface 40A and the second placement surface 40B. Therefore, the sheet S ejected through the first sheet exit 11A and placed on the first ejection tray 11 may be bended in the vicinity of the boundary 11B, in a view along the widthwise direction, in the shape of an "L" or a stretched "L."

The sheet S bended on the first ejection tray 11 may have a crease SC (see FIG. 9A), which extends along the widthwise direction, in the vicinity of the boundary 11B. Therefore, moment of inertia of area at a cross-section along a direction orthogonally to the widthwise direction may be increased, and the sheet S may tend to bend in the direction orthogonal to the widthwise direction.

Accordingly, even when bending moment to curl the sheet S into a roll is generated by the stress remaining in the sheet S placed on the first ejection tray 11, with the increased moment of inertia, the sheet S may not recover to the roll or may be prevented from being curled again.

Thus, the sheet S placed on the first ejection tray 11 may be maintained flat in the widthwise direction. Accordingly, collision between the widthwise ends SA, SB of the sheet S and a succeeding sheet may be avoided, and the succeeding sheet may be stacked on the preceding sheet S smoothly.

According to the embodiment described above, the guides 31 are located on the downstream side, or the frontward side, of the boundaries 12B, 13B, 14B, which are at the midst area in the second, third, fourth ejection trays 12, 13, 14, in the sheet-ejecting direction. The sheet being ejected through the first, second, third sheet exits 11A, 12A, 13A may be nipped by the first, second, third ejection rollers 21, 22, 23 respectively at the rear end thereof and pressed downward by the guides 31 at the front end thereof in the sheet-ejecting direction. Thus, the front end of the sheet being ejected may be turned downward to easily flatten the curl.

According to the embodiment described above, the second placement surfaces 40B and the second slanted surfaces 30B are arranged on the downstream side, or the frontward side, of the boundaries 11B, 12B, 13B, 14B in the sheet-ejecting direction. Meanwhile, the sheet-ejecting direction may be approximately in parallel with the first placement surfaces 40A or the first slanted surfaces 30A. In this regard, the degree of inclination of the second placement surfaces 40B and the second slanted surfaces 30B is smaller than the degree of inclination of the first placement surfaces 40A and the first slanted surfaces 30A. Therefore, the front end of the sheet being ejected may be pressed downward by the guide 31 in the upper position, with the angle difference between the inclination of the second placement surfaces 40B and the second slanted surfaces 30B and the sheet-ejecting direction. Thus, the sheet may be pressed downward more effectively.

According to the embodiment described above, the sheet may contact the contacting portion 31C of the guide 31. Therefore, the widthwise ends of the curled sheet may easily contact the planes in the contacting portion 31C of the guide 31 so that the curl may be stably flattened.

According to the embodiment described above, the projected figure of the actuator 50 on the hypothetical vertical plane spreading in parallel with the widthwise direction may be in the position between the projected figures of the guides 31. According to this arrangement, the sheet being ejected may be reliably detected.

Further, while the first sheet presser 51 and the guide 31 are arranged in the same widthwise position, the front end and the rear end of the sheet may be pressed at the same widthwise position. Thus, the curl in the sheet may be flattened more reliably.

4. More Examples

Although an example of carrying out the present disclosure have been described, those skilled in the art will appreciate that there are numerous variations and permutations of the sheet ejecting device and the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the guide 31 may not necessarily have the planar portion but may be in an edgy shape having, for example, a rib or a plurality of ribs.

For another example, the boundary between each first placement surface 40A and the second placement surface 40B may not necessarily be at the position distanced apart downstream, or frontward, from the upstream end of the first ejection tray 11 in the sheet ejecting direction for the predetermined (e.g., A6) length.

For another example, the first ejection tray 11 may not necessarily be different from the second, third, fourth ejection trays 12-14 in not having the guide 31 or the parallel portion 31D, but the first, second, third, fourth ejection trays 11-14 may be configured identically.

What is claimed is:

1. A sheet ejecting device, comprising:

a first ejection tray;

a first ejection roller configured to eject a sheet to the first ejection tray in a sheet-ejecting direction;

a second ejection tray disposed above the first ejection tray;

a second ejection roller configured to eject a sheet to the second ejection tray; and a first guide and a second guide disposed in a downstream portion on a lower surface of the second ejection tray at a position downstream from a midst area in the sheet-ejecting direction, the lower surface of the second ejection tray facing the first ejection tray, the first guide being disposed at a first widthwise end on the lower surface of the second ejection tray in a widthwise direction orthogonal to the sheet-ejecting direction, the second guide being disposed at a second widthwise end opposite to the first widthwise end in the widthwise direction, the first guide and the second guide being configured to contact a first widthwise end and a second widthwise end, respectively, in the widthwise direction, of the sheet ejected by the first ejection roller and guide downward the first widthwise end and the second widthwise end, respectively, of the sheet, wherein the first guide and the second guide each comprises a planar portion, at which each of the first guide and the second guide is configured to contact the sheet, the planar portion facing toward the first ejection tray and having a surface area larger than a surface area of each portion of the first guide and the second guide facing perpendicular to the first ejection tray, and a parallel portion that has a plane extending continuously downstream from the planar portion in the sheet-ejecting direction to spread in parallel with an upper surface of the first ejection tray, wherein a distance between the upper surface of the first ejection tray and the planar portion of the first and second guides is larger than a distance between the upper surface of the first ejection tray and the plane of the parallel portion of each of the first and second guides, and wherein the second ejection tray has an indentation at downstream end in the sheet-ejecting direction, the first guide being arranged on one side of the indentation in the widthwise direction, and the second guide being arranged on the opposite side of the indentation in the widthwise direction.

2. The sheet ejecting device according to claim 1, wherein the lower surface of the second ejection tray comprises a first slanted surface and a second slanted surface, the first slanted surface being located closer to the first ejection roller than the second slanted surface, the second slanted surface being located downstream of the first slanted surface in the sheet-ejecting direction; and wherein an angle between the second slanted surface and a horizontal plane is smaller than an angle between the first slanted surface and the horizontal plane.

3. The sheet ejecting device according to claim 2, wherein the first guide and the second guide are disposed on the second slanted surface.

4. The sheet ejecting device according to claim 2, wherein the upper surface of the first ejection tray comprises a first placement surface and a second placement surface, the first placement surface being located closer to the first ejection roller than the second placement surface, the second placement surface being located downstream of the first placement surface in the sheet-ejecting direction;

wherein an angle between the second placement surface and the horizontal plane is smaller than an angle between the first placement surface and the horizontal plane; and wherein at least a part of the second slanted surface is disposed above the second placement surface.

5. The sheet ejecting device according to claim 4, wherein a boundary between the first placement surface and the second placement surface is in a position downstream from a reference position which is distanced apart from an upstream end of the first ejection tray in the sheet-ejecting direction for a predetermined length, the predetermined length being a dimension of a longer side of an A6-sized sheet.

6. The sheet ejecting device according to claim 1, wherein an angle between a portion of each of the first guide and the second guide that is configured to contact the sheet and a horizontal plane is at least zero degrees and at most 45 degrees.

7. The sheet ejecting device according to claim 1, further comprising:

an actuator located downstream of the first ejection roller in the sheet-ejecting direction, the actuator being configured to deform by contact with the sheet, the actuator being configured to at least detect an amount of sheets ejected to the first ejection tray reaching a predetermined amount; and wherein a figure of the actuator being projected on a hypothetical vertical plane spreading in parallel with the widthwise direction is in a position between figures of the first guide and the second guide projected on the hypothetical vertical plane.

8. The sheet ejecting device according to claim 1, wherein the first ejection roller comprises a plurality of roller parts and a support shaft, the plurality of roller parts being configured to contact the sheet and rotate, the support shaft supporting the plurality of roller parts thereon; and wherein at least a part of a figure of each of the first guide and the second guide projected on a hypothetical vertical plane spreading in parallel with the widthwise direction coincides with a figure of at least one of the plurality of roller parts projected on the hypothetical vertical plane.

9. The sheet ejecting device according to claim 1, further comprising a sheet presser configured to press the sheet being ejected by the first ejection roller, the sheet presser being located downstream of the first ejection roller in the sheet-ejecting direction, wherein the sheet presser is located in a same position as one of the first guide and the second guide in the widthwise direction.

10. The sheet ejecting device according to claim 1, wherein the midst area is an area in a middle when the second ejection tray is trisected along the sheet-ejecting direction.

* * * * *